US006718851B1

(12) United States Patent
Peggion

(10) Patent No.: US 6,718,851 B1
(45) Date of Patent: Apr. 13, 2004

(54) TOOL WITH SELF-LOCKING GRIP, INTERCHANGEABLE HEAD-PIECES AND CLAMP FOR FASTENING TO THE WORK BENCH

(76) Inventor: Fernando Peggion, Via Punara, 1, San Giorgio Delle Pertiche (IT), I-35010

( * ) Notice: Subject to any disclaimer, the term of this patent is extended or adjusted under 35 U.S.C. 154(b) by 0 days.

(21) Appl. No.: 09/743,699

(22) PCT Filed: Jul. 2, 1999

(86) PCT No.: PCT/IT99/00200

§ 371 (c)(1),
(2), (4) Date: Jan. 16, 2001

(87) PCT Pub. No.: WO00/03843

PCT Pub. Date: Jan. 27, 2000

(30) Foreign Application Priority Data

Jul. 15, 1998 (IT) ..... CR98A0004

(51) Int. Cl.[7] ..... B25B 23/00
(52) U.S. Cl. ..... 81/462; 81/77
(58) Field of Search ..... 81/462, 77, 355, 81/356, 357, 361, 385, 391; 269/3, 6; 29/270, 268

(56) References Cited

U.S. PATENT DOCUMENTS 203,701 A * 5/1878 Brown, Sr. ..... 269/3
1,060,862 A * 5/1913 Seale ..... 81/77
1,140,018 A * 5/1915 Bean ..... 81/77
1,321,187 A * 11/1919 Brower ..... 81/77
1,451,184 A 4/1923 Small
1,575,448 A * 3/1926 Morris et al. ..... 81/77
1,678,216 A 7/1928 Greer
2,149,541 A 3/1939 Nagle
2,312,425 A 3/1943 Lepiane

FOREIGN PATENT DOCUMENTS

DE 308959 8/1955

* cited by examiner

*Primary Examiner*—James G. Smith
(74) *Attorney, Agent, or Firm*—Young & Thompson

(57) ABSTRACT

Tool with self-locking grip featuring a handle (1), two levers **(2*a*) and (2*b*), and a self-locking device (3), in which the handle (1) features a main body (45), containing two prismatic housing-guides (4*a*) and (4*b*) which hold the two levers. These are removable and interchangeable with other levers for performing different mechanical functions, where the self-locking device (3) is kinetically connected between the main body (45) and one of the levers. The main body (45) also contains a third prismatic guide (9) for a further removable lever (10); this lever, being connected as required to the same a self-locking device (3) and sliding inside its own housing, approaching a counter element (14) fixed to the main body (45)** allows vice-like fastening of the tool to a protruding part of the work bench.

23 Claims, 9 Drawing Sheets

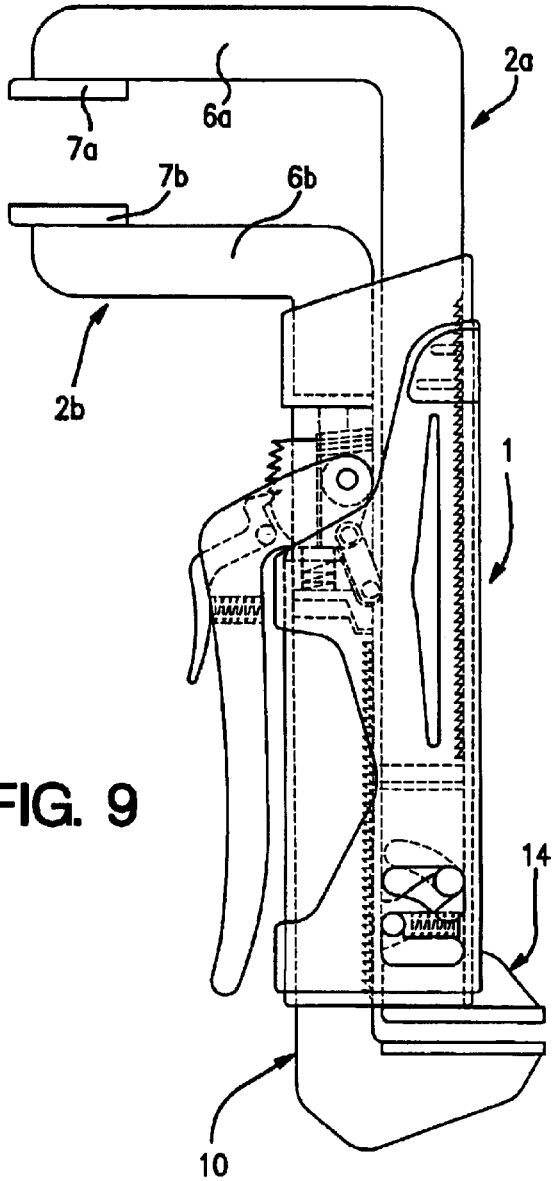
FIG. 9
FIG. 10
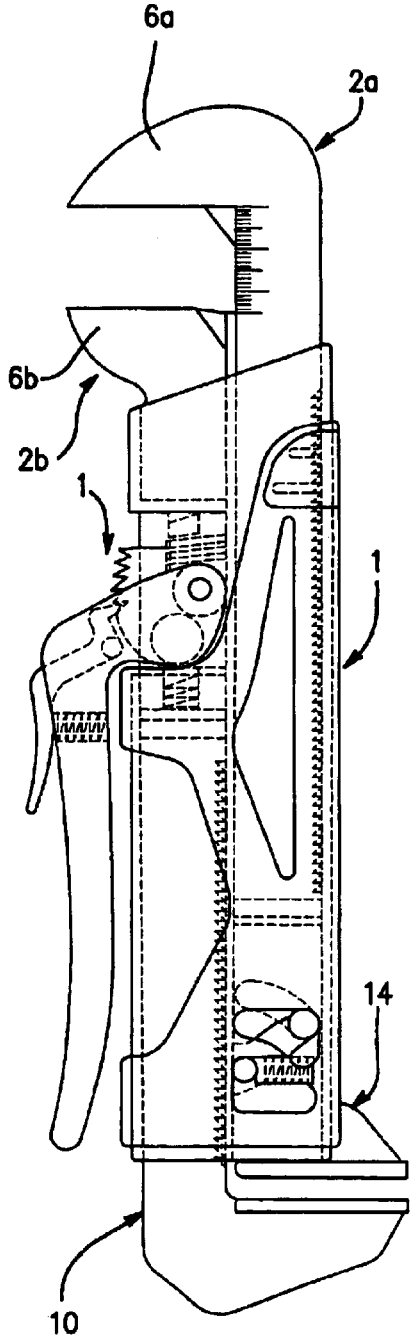

TOOL WITH SELF-LOCKING GRIP, INTERCHANGEABLE HEAD-PIECES AND CLAMP FOR FASTENING TO THE WORK BENCH

BACKGROUND OF THE INVENTION

The invention relates to a tool with self-locking grip, interchangeable head-pieces and clamp for fastening to a work bench.

DESCRIPTION OF THE RELATED ART

It is well known that there is currently a vast range of work tools made up essentially of two levers, also known as gripping arms, which are permanently fastened to the handle, with at least one of the gripping arms or levers being mobile.

Jaws are generally provided at the end of the arms, for holding a workpiece. In some cases the ends of the arms comprise devices specially adapted to some operations, for example, for cutting a pipe, punching holes, etc.

These work tools are generally designed to perform just one task, depending on the type and shape of the jaws, the means provided for regulating the distance between the ends of the arms, and the possibility of locking the arms using a specific self-locking system.

For this reason, there is an almost endless variety of two-gripping arms tools on the market today, the more common of which being: self-locking pliers with screw-adjustment of the distance between the jaws and the locking pressure; adjustable pipe wrenches which allow the distance between the jaws to be set; wrenches featuring one movable jaw which slides along a worm screw-lead screw system; pipe cutters with cutting wheel set at the end of at least one of the gripping arms; punches for punching holes in soft sheet material, etc.

As a result, different operations normally require the purchase of different tools with greater expense and transport and handling problems.

U.S. Pat. No. 2,312,425 describes a wrench wherein it is easy to place the jaws in gripping relation to the work, and having interchangeable jaws of different contours, suitable to particular types of work.

The wrench comprises an elongated flat transversely rectangular casing having an open end and a closed end, and an elongated longitudinal slot in one edge thereof, a pair of jaw members having flat shanks extending into said open end of the casing and relatively slidable in edge-to-edge engaging relation therein, inwardly and outwardly of said open end, respectively, into different positions, detent means for releasably holding one shank in different positions, a spring in said casing having its ends fastened to the inner end of the other shank and to the closed end of the casing, respectively, in the line of movement of said other shank and tensioning said other shank against outward sliding, and means to slide said other shank outwardly in opposition to said spring comprising a lateral edge lug on said other shank extending into the slot in said one edge of the casing flush with said edge, a pair of opposed ears extending from said one edge of the casing at opposite sides of said slot, a cam pivoted between said lugs and having a handle and a radial shoulder rotatable into said slot into camming engagement with said lug.

The main disadvantages of the wrench consist in that is difficult to unfasten the spring and to interchange the shank without disassembling the casing.

The interchangeability is theoretic more than practical.

Moreover, the thickness of the object to be gripped does not allow the handle to find a rest in the casing.

Furthermore, the user must hold the wrench in his hand while he is working, and this means that one hand is constantly engaged.

Finally, the compression of the handle always causes the lower jaw to move towards the upper jaw, whereas in some works it is more convenient that the upper jaw moves towards the lower one.

In U.S. Pat. No. 2,149,541 a wrench is disclosed having a handle and a pair of complemental jaws. The jaws have some type of removable jaw members attached to the regular jaws of the wrench, in order to provide alternatively a smooth flat clamping surface on the jaws, or a punch member, or a cutting pipe device.

The main defect consists in that the jaws are not interchangeable, but may just be fitted by applying thereto devices of reduced dimensions, which aren't practical and are weak. Further disadvantages consist in that the wrench lacks a device for blocking the jaws in position, and that the push of the user on the handle is not balanced, thus forcing the user himself to use not only one, but both hands to do his work.

Furthermore, none of the more commonly available tools has the option of being fastened directly to the work bench; indeed, even tools designed to hold two objects for operations such as welding or gluing, must be fastened to the bench using a traditional vice, in order to allow the user to have both hands free.

Said bench vice, may also damage or deform the handle of the tool.

SUMMARY OF THE INVENTION

The aim of this invention is to eliminate all of the problems described above.

In particular, the main objective of the invention is to realize a tool with removable and interchangeable gripping arms, for performing a wide variety of tasks.

A further objective is the possibility of fastening the tool to the work bench using a specific, incorporated device, which is operated by the same self-locking system of the arms.

These and other objectives are fulfilled by the invention, a self-locking tool comprising a handle, two gripping arms and a self-locking system, wherein the handle of the tool comprise a main body with two prismatic housing-guides, holding and guiding said two arms; the arms are removable and interchangeable with other arms and fitted with ends adapted for performing a range of mechanical functions; the self-locking device is connected between the body of the handle and one of the arms, so that operation of the device causes a sliding of said one of the arms, whose end approaches the end of the other gripping arm, this last being fixed inside its housing, to give a gripping effect and locking into position when closed.

The main body of the handle contains at least a third prismatic housing-guide, for a further removable gripping arm at the opposite end of the handle; this arm being connected to the same self-locking device and sliding inside its housing, for fastening the tool to a workbench, in cooperation with a fixed element.

Moreover, the gripping area of the ends of the arms is advantageously fitted with removable devices which can be easily replaced.

The advantages of this invention consist, in general, in the fact that several different applications can be performed using one single handle, costs for the purchasing of a complete kit of tools are reduced, and the user can work alone, without using a vice to clamp the wrench.

Further advantages are the possibility to obtain a greater opening of the jaws at the end of the gripping arms; the possibility to have a progressive pressure between the end of the gripping arms using a claw device, fitted in the self-blocking lever (useful, for example, when cutting pipes); the high force allowed by the kinematic movement of the self-locking lever (useful for example, to trim or punch), etc.

BRIEF DESCRIPTION OF THE DRAWINGS

Finally, further characteristics and advantages of the invention will be better highlighted by the more detailed description as follows, with the help of drawings showing some preferred embodiments and common applications. The drawings are provided as examples only, and do not represent the complete range of possibilities.

FIGS. 9, 10, 11, and 12 show a side view of the tool respectively and illustratively fitted with jaws for holding objects in place for operations such as welding or gluing, jaws for tightening or loosening bolts, jaws with a pipe cutting device, and jaws with a device for punching holes.

DESCRIPTION OF THE PREFERRED EMBODIMENTS

With reference to the details shown in the figures, the invention features a handle 1, two gripping arms 2*a* and 2*b*, and a self-locking lever device 3.

The handle of the tool 1 comprises a main body 45, with two internal prismatic housing-guides 4*a* and 4*b*, holding and guiding respectively the two arms 2*a* and 2*b*.

Each of the arms 2*a* and 2*b* comprises a prismatic portion 5*a*, 5*b* which can be inserted in the two prismatic housing-guides 4*a* and 4*b*, and external ends 6*a* and 6*b*, which remain external to the main body upon insertion.

Figure 11:
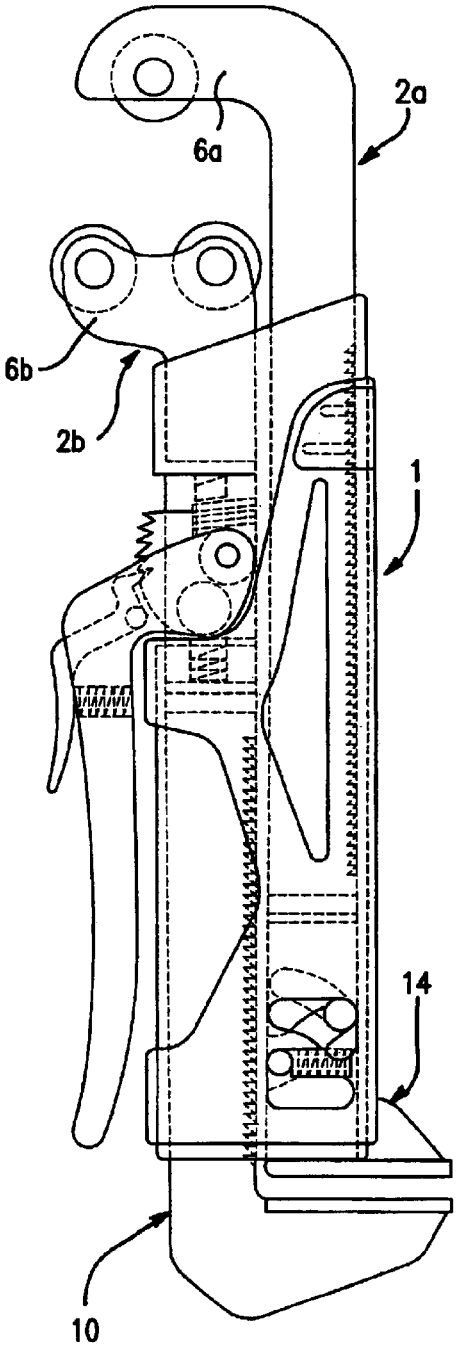
Figure 12:
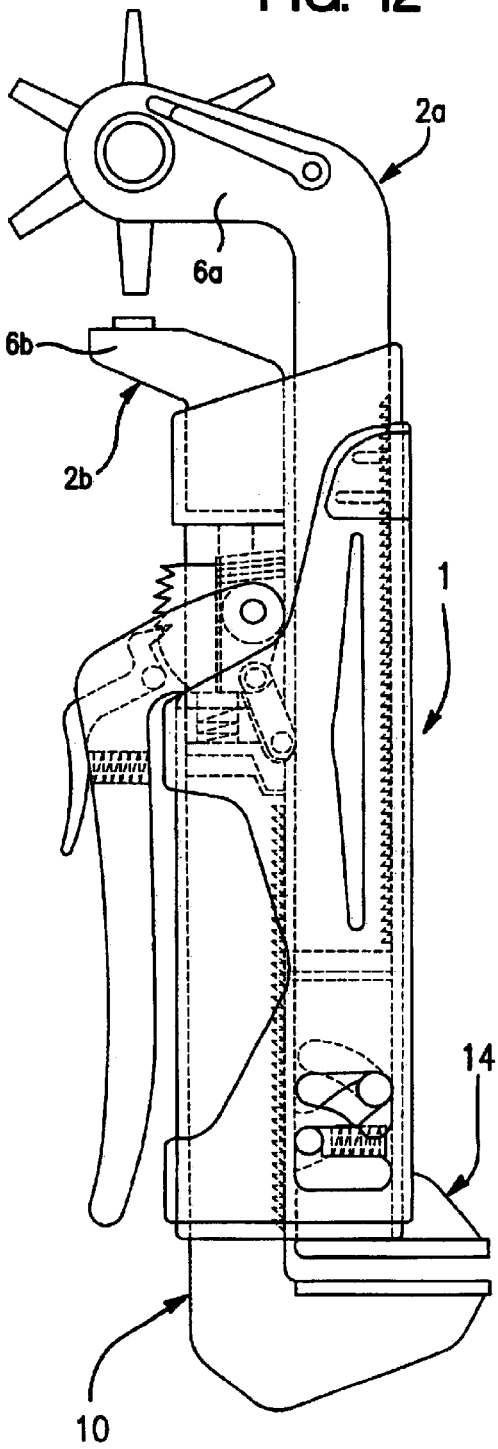

The gripping arms 2*a* and 2*b* are thus removable and interchangeable with other gripping arms, provided that each of said interchangeable gripping arms comprise a prismatic portion, substantially identical to said prismatic portions 5*a* and 5*b*, and is fitted with an external end adapted to the use. For example, external ends of the gripping arms may work as jaws as shown in FIGS. 1 to 10, or support other tools, as shown in FIGS. 11 and 12.

In the case where ends 6*a* and 6*b* work as jaws, their gripping portions 7*a* and 7*b* are fitted with a track guide 46, which allows their replacement to modify the shape of the gripping zone or to change the grip materials.

Both the shape and the materials of the gripping portions may be varied according to the requirements of the application.

The materials which may be used include rubber, Teflon, copper, etc., in addition to the standard steel.

The prismatic portion 5*a* of arm 2*a* comprises, on one side, selective locking means, which in the embodiments shown are obtained with a rack 8.

Furthermore, the main body 45 of the handle 1 comprises a third prismatic housing-guide 9, for housing and guiding a third gripping arm 10.

The gripping arm 10 comprises a prismatic portion 11 which can be inserted in the prismatic housing-guide 9, and an end 12 working as a jaw.

The prismatic portion 11 of arm 10 also features, on one side, selective locking means 13, which in the embodiment shown are saw-tooth shaped, like those of the gripping arm 2*a*.

A removable element 14, having a gripping portion 15 adapted to cooperate with the corresponding gripping portion of the jaw 12 for fastening the tool to a workbench, is associated to body 45, with locking means 48 or 49.

The self locking lever device 3 is connected to the main body 45 and to one of the gripping arms, namely the arm 2*a* or the arm 2*b*, so that the operation of the device 3 cause said gripping arm to slide inside its guide 4*a* or 4*b*, the external end of said arm thus moving towards the end of the other gripping arm, where this last is fixed, giving a gripping effect. Moreover, the device 3 is adapted to lock said gripping arm into position, when closed.

Figure 1:
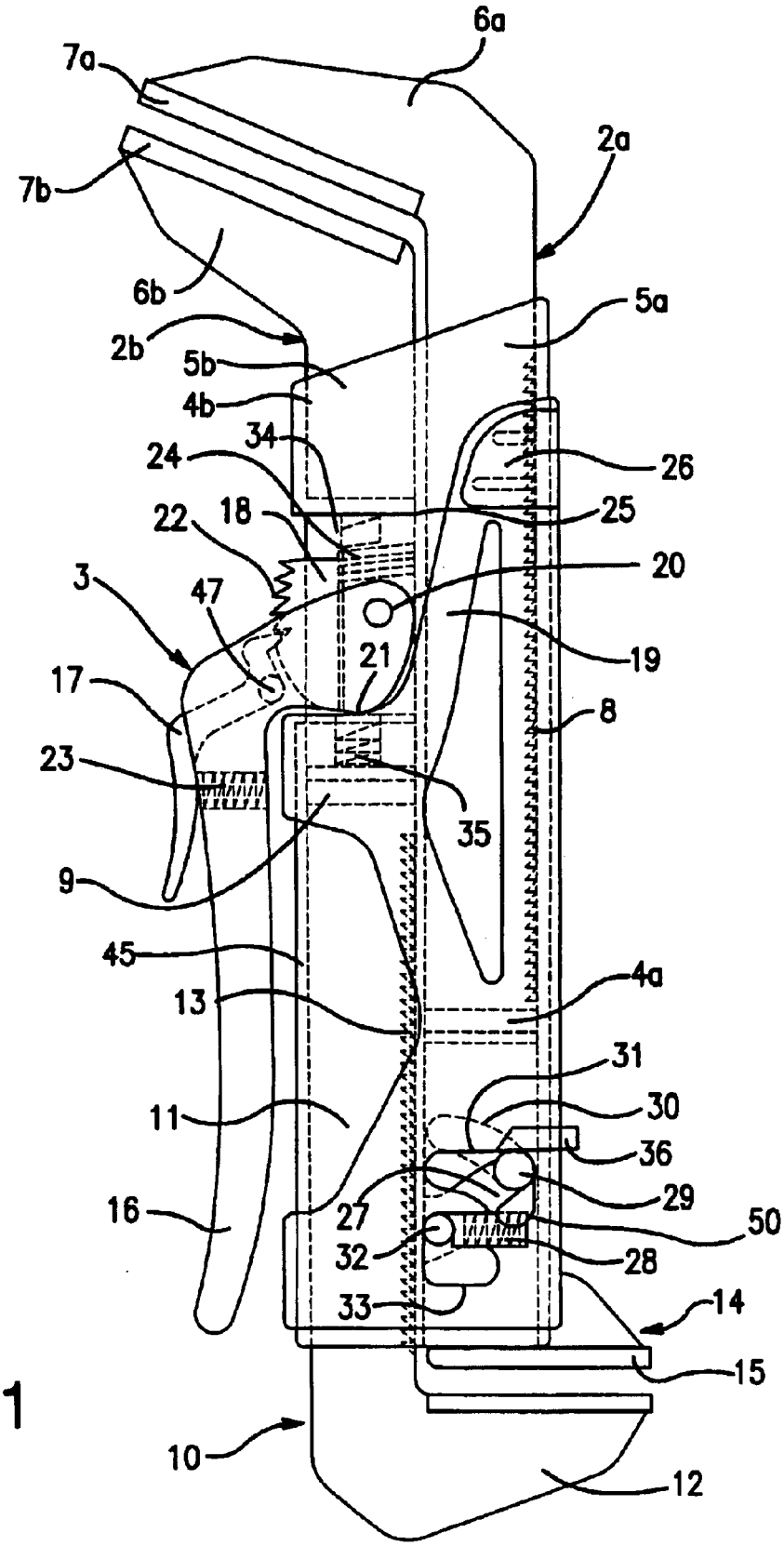
FIG. 1 shows a side view with hidden lines dashed, of the self-blocking tool in grip closed position, the principle version of this invention.
Figure 2:
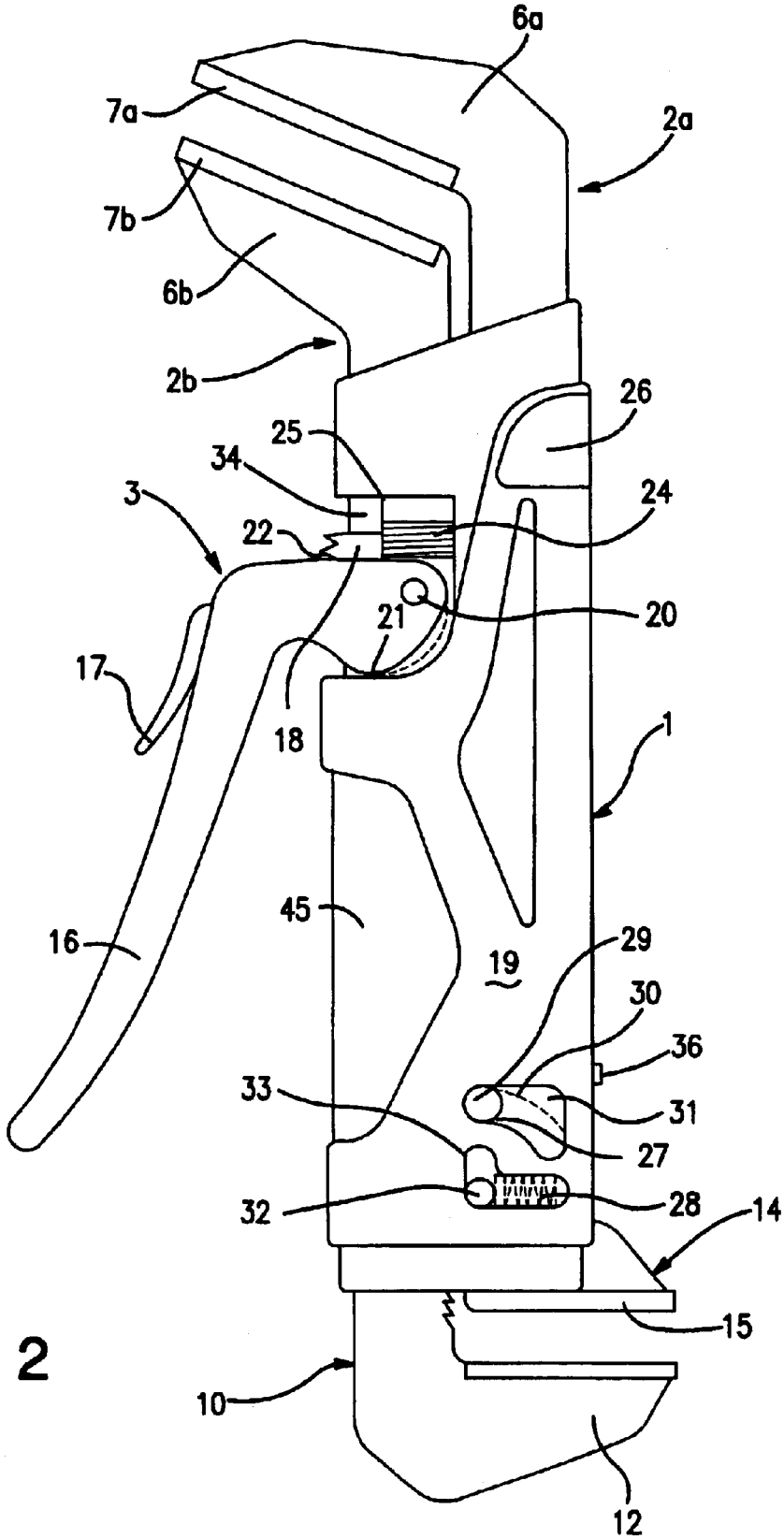
FIG. 2 shows a side view of the same tool, in open release position.

With reference to the embodiment of the tool shown in FIGS. 1 and 2, the self-locking device 3 comprises a manoeuvring lever 16, a spike 17, a sliding block 18 and a saddle 19.

Figure 3:
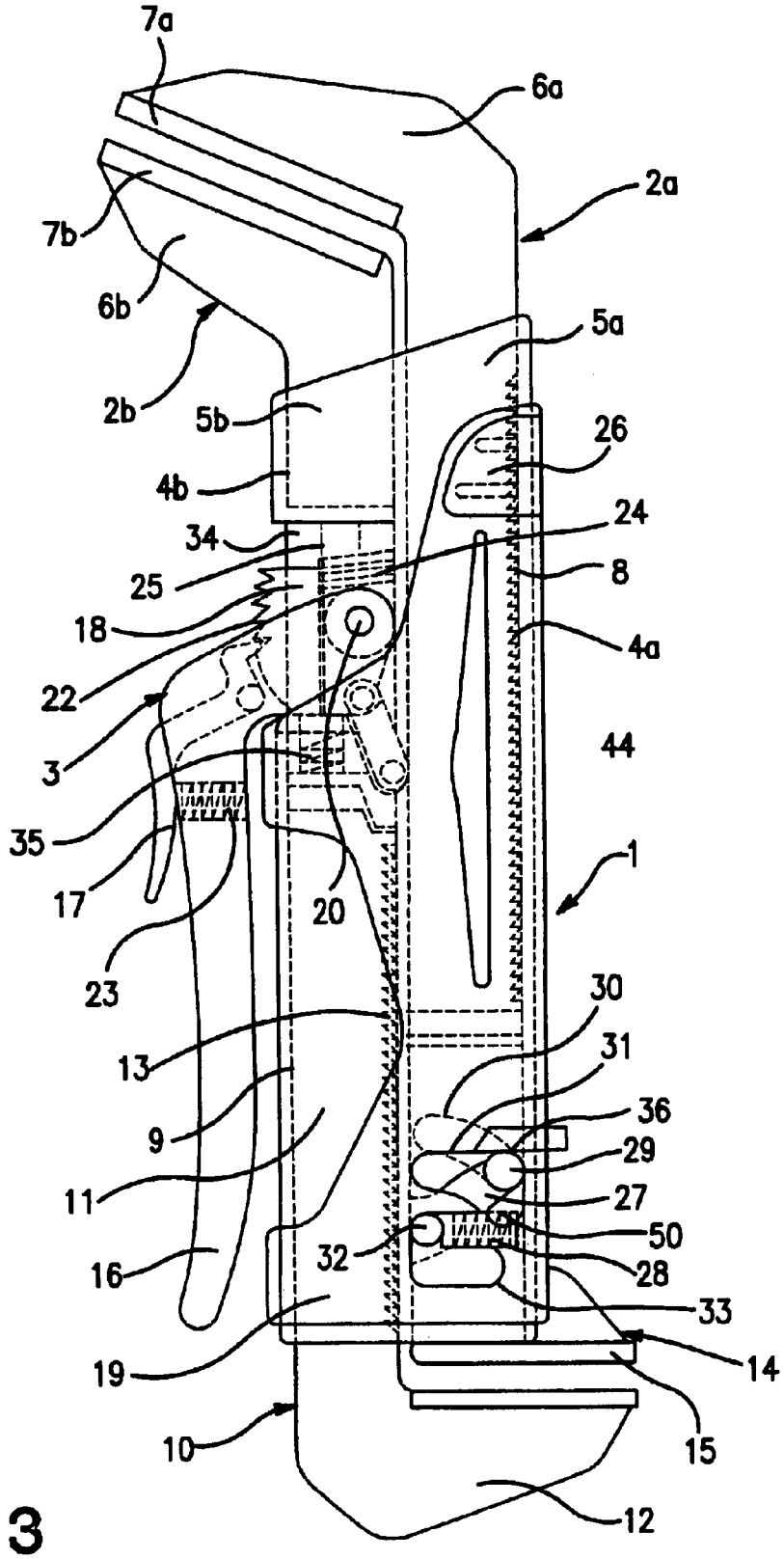
FIG. 3 shows a side view with hidden lines dashed, the self-blocking tool in grip closed position, one possible variation.
Figure 4:
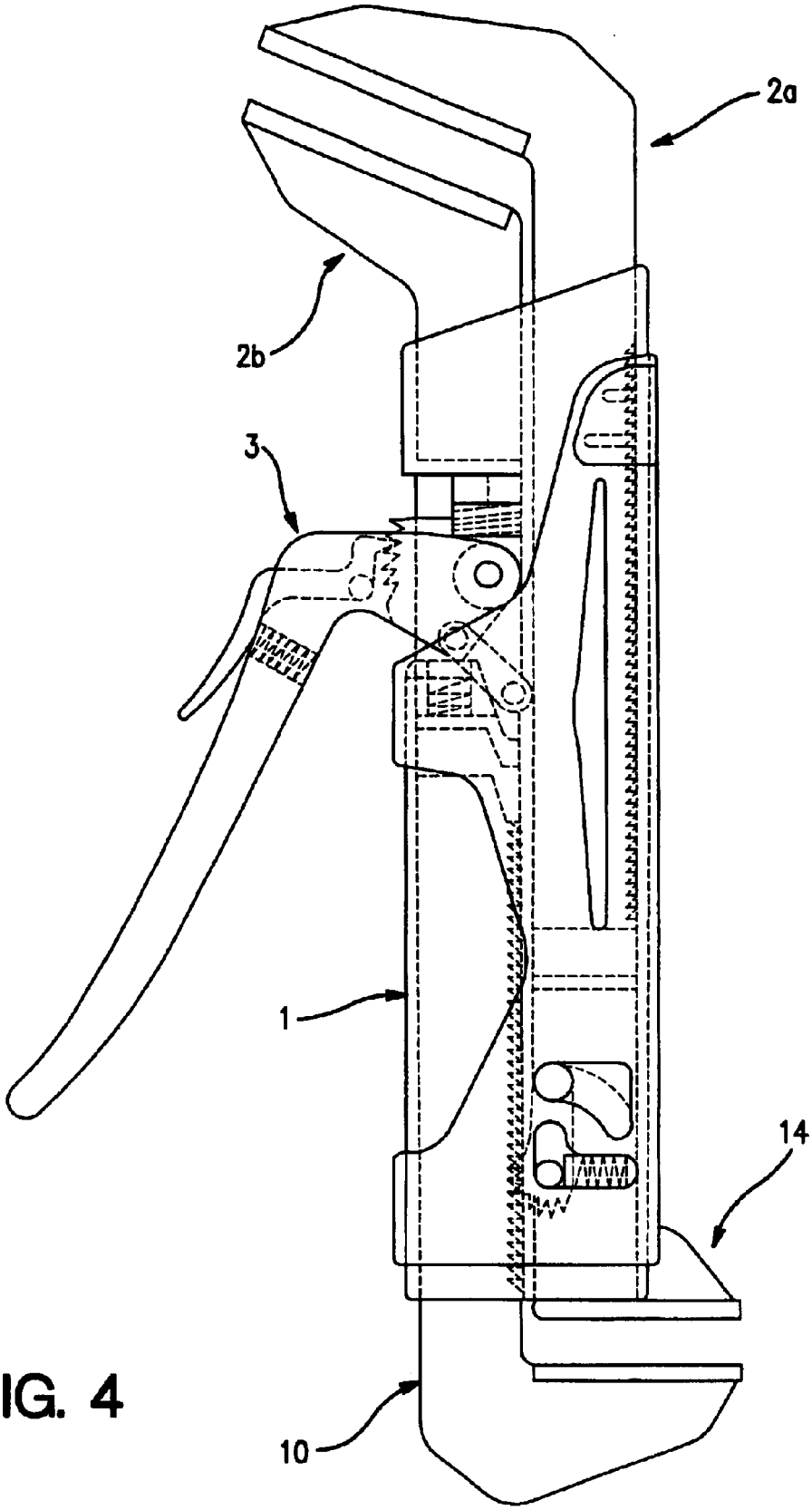
FIG. 4 shows the same variation of the tool as in FIG. 3, in open release position.

The manoeuvring lever 16 is pivoted on the sliding block 18 using a pin 20 and connected to saddle 19 through a cam 21, as shown in FIG. 1, or otherwise using a rod 44, as shown in the alternative versions of FIGS. 3 and 4.

The spike 17 is pivoted on the manoeuvring lever 16 using a pin 47 and is engaged with a rack 22 on the sliding block 18 by the effect of a spring 23.

The spike 17 and the rack 22 allow multiple locking positions of the manoeuvring lever 16.

A worm screw and nut screw device, made up of a reel 24 pivoted on the sliding block 18 and engaged with a nut screw 25, housed in the main body 45 of handle 1, allow small movements of the sliding block 18 along the rail guide 34, and consequently of the manoeuvring lever 16, for adjusting the gripping force between the ends 6*a*, 6*b*, 12 and 15.

The saddle 19 slides in both directions along the main body 45, contrasted by the spring 35.

The saddle 19 is connected to arm 2*a* through a connection device 26, fitted with teeth adapted to engage the rack 8.

This device 26 is meshed in the saddle 19 using rail-type connection means, adapted to remove it from rack 8, for disconnecting the saddle 19 from arm 2*a*, and moving the arm to the desired starting position.

The saddle 19, finally, is also connected to arm 10 using a pawl 27, fitted with teeth adapted to engage rack 13, due to the action of a spring 28.

The pawl 27 is also fitted with a pin 29 which slides or rotates along the surfaces bordering the slotted holes 30 and 31, on the main body of handle 1 and the saddle 19, as well as with a second pin 32 which slides in slotted hole 33 on saddle 19, and, if required, horizontally in a slotted hole 50 of the main body 45, countered by spring 28.

The first pin 29 allows selective engagement of means blocking the pawl 27, e.g. a hook 36 pivoted to the main body 45 of handle 1.

The second pin 32 is pushed towards the teeth 13 by the spring 28 housed in the main body 45.

Figure 5:
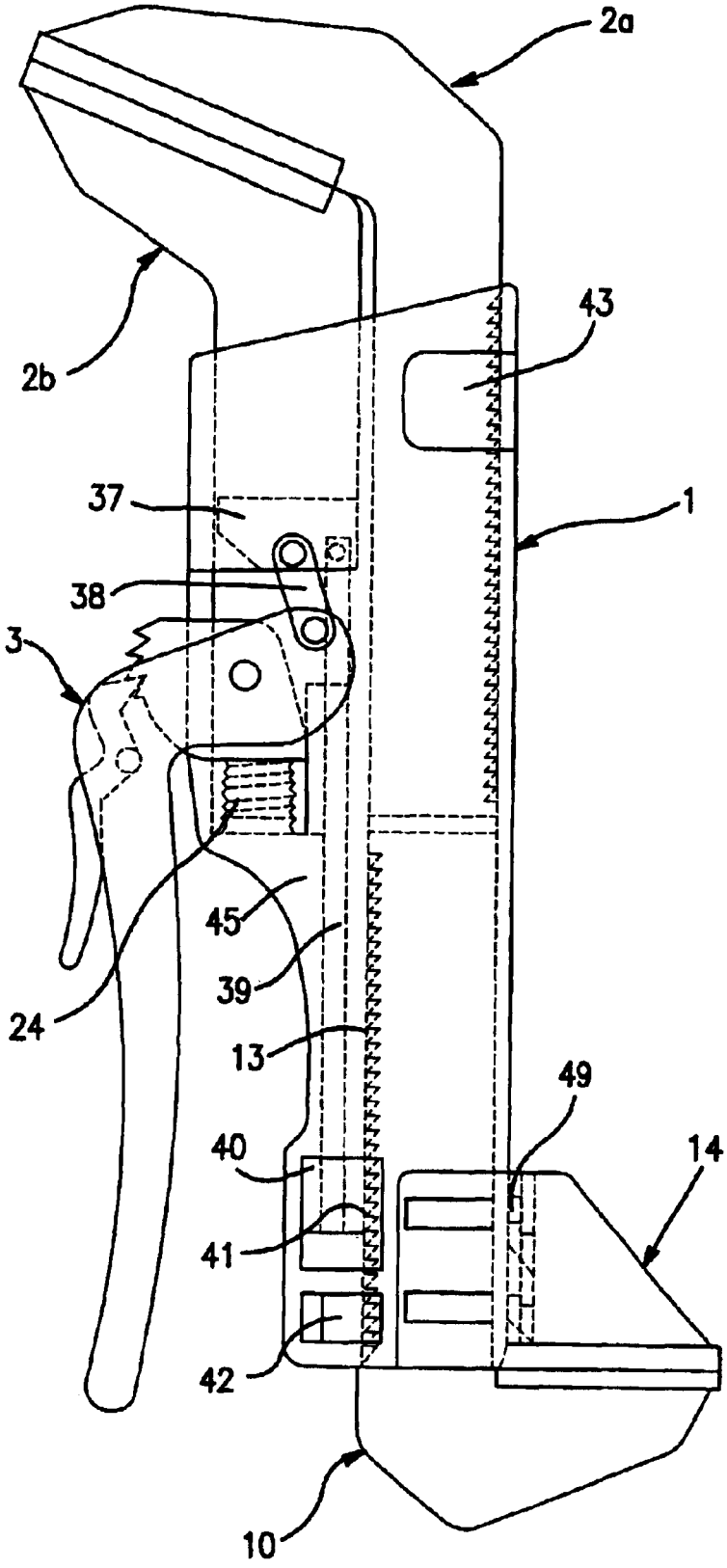
FIG. 5 shows a side view with hidden lines dashed, the self-blocking tool in grip position closed, a further possible variation.
Figure 6:
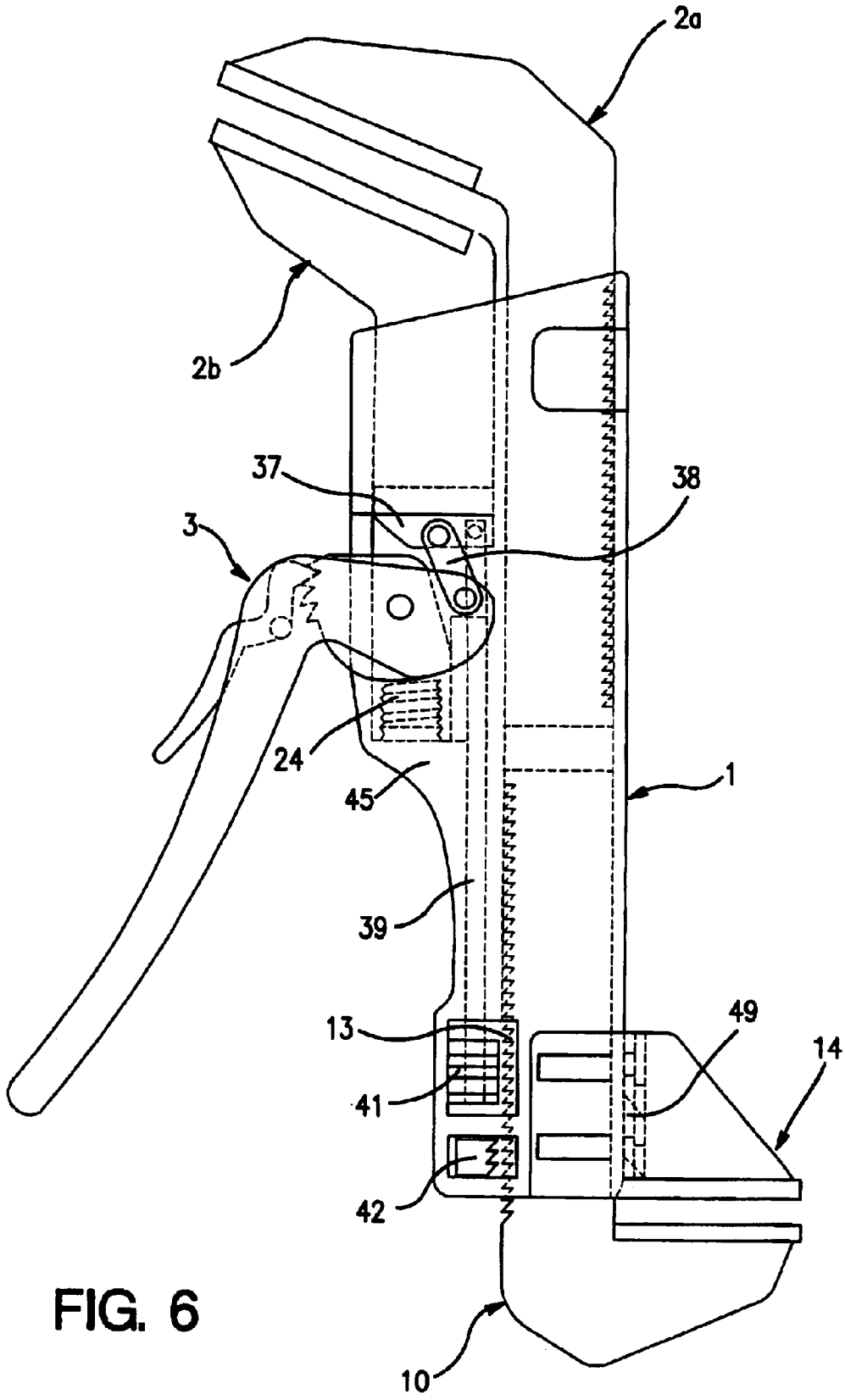
FIG. 6 shows the same variation of the tool as in FIG. 5, in open release position.
Figure 7:
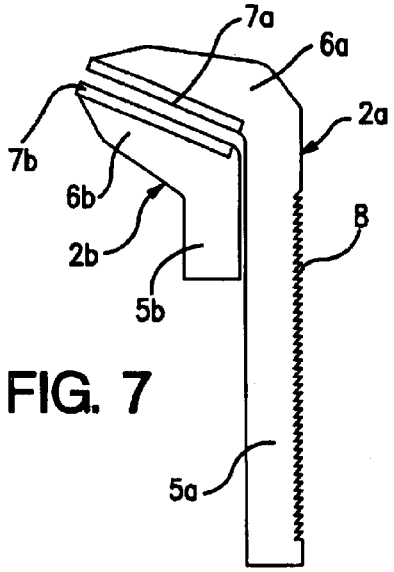
FIG. 7 shows a side view of the interchangeable gripping arms of the tool.
Figure 8:
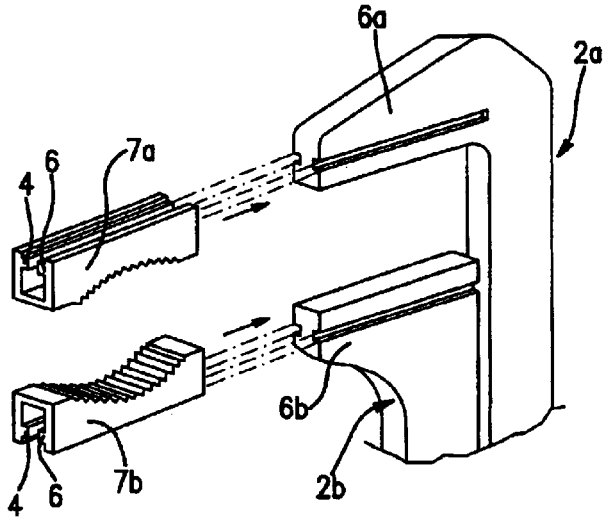
FIG. 8 shows an exploded perspective view of the jaws at the ends of the interchangeable gripping arms, with an example of the replaceable grip zone.
Figure 13:
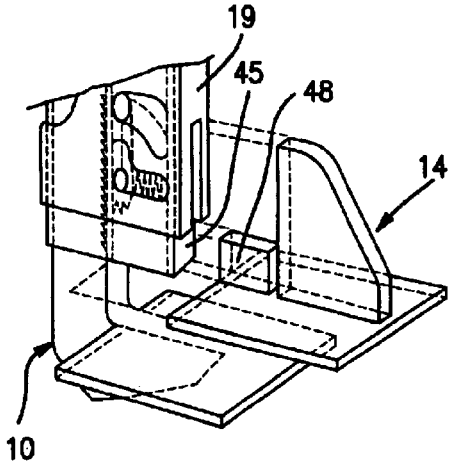
FIG. 13 shows an exploded perspective view of the fixed element for the locking jaw of the tool, in the versions illustrated in FIGS. 1, 2, 3, and 4.
Figure 14:
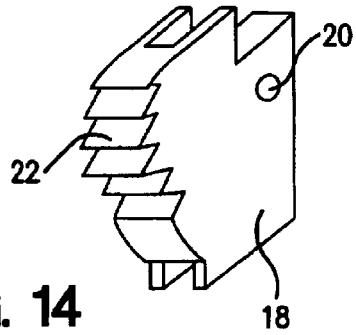
FIG. 14 shows a perspective view of the sliding block on which the manoeuvring lever of the self-blocking lever device pivots.
Figure 15:
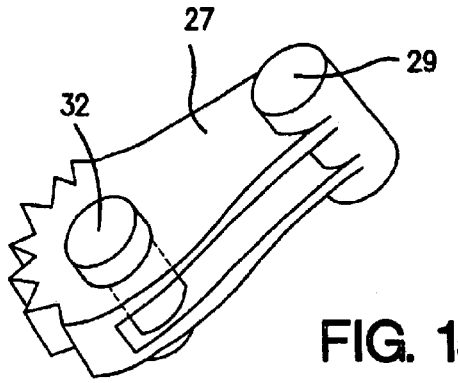
FIG. 15 shows a perspective view of the ratchet of the handle, which allows the tool to be fastened to the work bench.

In a second version of the tool, as illustrated in FIGS. 5 and 6, the saddle 19 is replaced with a block 37 which slides inside guide 4*b*of arm 2*b*.

This block 37 is connected to manoeuvring lever 16 using a connecting rod 38 and to arm 10 using a rod 39, at the lower end of which is fastened a rotating reel 40, a portion of the side surface of which is fitted with teeth 41 engaging the teeth 13.

In this version, arm 10 is inserted into a prismatic guide which is coaxial to that of arm 2*a*; the position of the arm 10 can be selectively blocked as required using a locking device 42 of teeth 13 fixed to the main body 45 of handle 1.

In a further version of the device, which is not illustrated, arm 10 is absent and element 14 is replaced by magnetic fastening means.

In the preferred embodiment of the tool, arm 2*a* can be inserted in housing 4*a* by disconnecting device 26, while arm 2*b* can be directly inserted into housing 4*b*.

The connecting device 26 also allows the setting of the initial distance between jaws 6*a* and 6*b*.

Arm 10 can be disconnected (or inserted) from housing 9 by disconnecting pawl 27, acting on pin 32 which can horizontally slide in slotted hole 33, against the force of spring 28.

Element 14 can be fastened at the end of the main body 45 of handle 1 using locking elements 48 of known type.

Acting on manoeuvring lever 16, the saddle 19 slides downwards, dragging arm 2*a*, whose end 6*a* approaches end 6*b* of lever 2*b*, which remains fixed in its housing.

At the same time, pin 29 slides along slotted hole 30, dragged by slotted hole 31.

In this way the toothed side of pawl 27 engaging rack 13 of arm 10, makes it slide upwards, causing the end 12 to approach the grip portion 15 of element 14.

This movement allows the vice, made up of jaws 12 and 14, to fasten the tool to a protruding part of a work bench.

Lever 16 is kept in position by spike 17 which meshes in the teeth 22 of block 18, thanks to the action of spring 23.

In this way it is possible to keep a fixed distance both between end 6*a* and 6*b* of gripping arms 2*a* and 2*b*, and between the end jaw 12 of arm 10 and the grip portion 15 of element 14.

Reel 24 can be used to adjust the pressure on the object tightened between these elements with greater precision.

To fasten the grip of the jaws 10 and 14, hook 36 acting on pawl 27 can be used. In this way, even further upward movement of saddle 19 will not separate arm 10 from element 14, keeping the tool fastened to the work bench.

As a consequence, the fine adjustment of the pressure between arms 2*a* and 2*b* or 10 and 14, using reel 24, can be performed independently, depending on whether the hook 36 is inserted or not.

In the second version of the tool, acting on manoeuvring lever 16, block 37 slides inside housing 4*b*, pushing arm 2*b* upwards, whose end 6*b* approaches end 6*a* of arm 2*a*.

At the same time, rod 39 slides and drags the arm 10, via reel 40, whose teeth 41 are meshed in rack 13.

To block the arm 10 and free the movement of arms 2*a* and 2*b* from the movement of arm 10, the user can turn the reel 40, so as to disengage teeth 41 from rack 13.

This operation thus allows the upper section of the tool, made up of gripping arms 2*a* and 2*b*, to be made independent from the lower portion (or vice), made up of elements 10 and 14, which can remain closed even when the lever 16 is opened.

For removing arm 10 from its housing, the user removes the locking element 42 from rack 13, after disengaging teeth 41 of the reel 40.

To remove arm 2*a* from its housing 4*a*, the user must disconnect the teeth of locking element 43, fastened in a removable manner to handle 1, from teeth 8 of arm 2*a*.

What is claimed is:

1. Tool with self-locking grip comprising:

a handle (1), two gripping arms (2*a* and 2*b*), each gripping arm fitted with an external end (6*a* and 6*b*), and a locking device (3), the handle of the tool (1) comprising a main body (45) with two prismatic housing-guides (4*a* and 4*b*), which housing-guides hold and guide the two gripping arms of the tool, a fixed element (14) attached to the main body, said two gripping arms (2*a* and 2*b*) removable and interchangeable with other gripping arms, the other gripping arms each fitted with a further external end (6*a* and 6*b*), the further external ends of the other gripping arms designed for performing a range of mechanical functions, the locking device (3) being connected to the main body (45) and one of the two gripping arms (2*a*), so that the operation of said locking device (3) causes said one gripping arm (2*a*) to slide inside its housing-guide (4*a*), this movement resulting in the external end (6*a*) of said one gripping arm (2*a*) moving towards the external end (6*b*) of the other gripping arm (2*b*), which other arm (2*b*) remains stationary inside its housing (4*b*), thus creating a gripping effect between the two gripping arms and a locking effect, wherein the main body (45) comprises a third prismatic housing-guide (9) which houses a further removable gripping arm (10) located at an end of the main body (45) opposite to said two gripping arms (2*a* and 2*b*); and said further removable gripping arm (10) is also connected to the locking device (3) and slides inside the third housing-guide (9), cooperating with the fixed element (14) for fastening the tool to a work bench.

2. Tool, as claimed in claim 1, characterized by the fact that said two gripping arms (2*a* and 2*b*) each feature respectively a prismatic portion (5*a* and 5*b*), which can be inserted in the two prismatic housing-guides (4*a* and 4*b*), and the external ends (6*a* and 6*b*) of the gripping arms, remain outside the main body (45) of the handle (1).

3. Tool, as claimed in claim 2, characterized by the fact that the external ends (6*a* and 6*b*) of the two gripping arms (2*a* and 2*b*) act as jaws, and include replaceable gripping portions (7*a* and 7*b*) fitted with mobile fastening elements at the ends, whose replacement allows the changing of the shape of the gripping area or the structural material of the parts which come into contact with the object to be gripped.

4. Tool, as claimed in claim 2, characterized by the fact that the prismatic portion (5*a*) of said one gripping arm (2*a*) is fitted with elements (8) for locking to the main body (45) of handle (1).

5. Tool, as claimed in claim 1, characterized by the fact that said further removable gripping arm (10) includes:

a prismatic portion (11), and can be inserted in the third prismatic housing guide (9), elements (13) for locking in the main body (45) of handle (1), and a protruding end (12) acting as an opposite jaw (12).

6. Tool, as claimed in claim 5, wherein, the fixed element (14) includes a gripping portion (17), and the opposite jaw (12) and the fixed element (14) with gripping portion (15) can be removed from the main body (45).

7. Tool, as claimed in claim 1, characterized by the fact that said locking device (3) is self-locking.

8. Tool, as claimed in claim 1, characterized by a self-locking device comprising one maneuvering lever (16), one spike (17), one sliding block (18) and one saddle (19).

9. Tool, as claimed in claim 8, characterized by the fact that the maneuvering lever (16) is pivoted on the sliding block (18) using a pin (20) and connected to the saddle (19) through contact with the surface of a cam (21).

10. Tool, as claimed in claim 8, characterized by the fact that the maneuvering lever (16) is pivoted on the sliding block (18) using a pin (20) and connected to the saddle (19) by a rod (44).

11. Tool, as claimed in claim 8, characterized by the fact that the spike (17) is pivoted on the maneuvering lever (16) using a pin (47) and is meshed in teeth of a rack (22) present on the sliding block (18), due to the action of a spring (23).

12. Tool, as claimed in claim 8, characterized by the fact that a reel (24) is meshed in sliding block (18) and rotates on a nut screw (25) housed in the main body (45), allowing small movements of the sliding block (18) along a rail guide (34), and consequently also of the maneuvering lever (16), in order to finely adjust the gripping strength between the external ends.

13. Tool, as claimed in claim 8, characterized by the fact that the saddle (19) slides in both directions along the main body (45) of handle (1), countered by a return spring (35).

14. Tool, as claimed in claim 8, characterized by the fact that the saddle (19) is connected to a lever (2*a*) using a removable connection device (26), fitted with suitable teeth for meshing in a rack (8) in plural positions.

15. Tool, as claimed in claim 8, characterized by the fact that the saddle (19) is connected to a lever (10) using a pawl (27), fitted with teeth for meshing in a rack (13), due to the effect of a spring (28), housed in the main body (45).

16. Tool, as claimed in claim 15, characterized by the fact the pawl (27) is also fitted with a pin (29) which slides on the surfaces bordering slotted holes (30 and 31), respectively in the main body (45) of handle (1) and in the saddle (19), as well as a second pin (32) which slides in a slotted hole (33) on the saddle (19), and horizontally in a slotted hole (50) on the main body (45), countered by the spring (28).

17. Tool, as claimed in claim 1, characterized by the fact that the locking device (3) includes a maneuvering lever (16), a spike (17), a sliding block (18), and a block (37).

18. Tool, as claimed in claim 17, characterized by the fact that the block (37) is connected to the maneuvering lever (16) using a connecting rod (38), and to another lever (10) using a rod (39).

19. Tool, as claimed in claim 18, characterized by the fact that a rotating reel (40) is fastened to the lower end of the rod (39), the reel having a rounded portion with a side surface fitted with teeth (41) for meshing in teeth (13) of the another lever (10).

20. Tool, as claimed in claim 19, characterized by the fact that the another lever (10) is inserted in a fourth prismatic guide which is coaxial to another of the prismatic guides, and whose position can be blocked as required using the locking device (42) of teeth (13), fastened to the main body (45) of handle (1).

21. Tool, as claimed in claim 1, characterized by the fact that the fixed element (14) includes magnetic elements which act on iron-based parts of the work bench, allowing the tool to be magnetically fastened to the work bench itself.

22. A tool with a self-locking grip and interchangeable head-pieces, comprising:

a handle (1);

a first gripping arm (2*a*), a second gripping arm (2*b*), and a third gripping arm (10);

a first prismatic portion (5*a*) located on the first gripping arm, a second prismatic portion (5*b*) located on the second gripping arm, and a third prismatic portion (11) located on the third gripping arm;

a first external end (6*a*) located on the first gripping arm, a second external end (6*b*) located on the second gripping arm, and a third external end located on the third gripping arm;

the handle comprising a main body (45), a first prismatic housing-guide (4*a*), a second prismatic housing-guide (4*b*), and a third prismatic housing-guide (9) contained within the main body, the first prismatic portion inserted in the first housing-guide, the first housing-guide holding and guiding the first gripping arm, and the first external end being external to the main body, the second prismatic portion inserted in the second housing-guide, the second housing-guide holding and guiding the second gripping arm, and the second external end being external to the main body, the third prismatic portion inserted in the third housing-guide, the third housing-guide holding and guiding the third gripping arm, and the third external end being external to the main body, each gripping arm being removable from the main body;

selective locking elements located on the first prismatic portion; and a self-locking lever device (3) connected to lock into place one of the gripping arms.

23. A tool system providing a tool with a self-locking grip and interchangeable head-pieces, comprising:

a tool handle (1);

three gripping arms interchangeably serving as a first gripping arm (2*a*) and a second gripping arm (2*b*) and third gripping arm (10) within the tool handle, the three gripping arms comprising a like prismatic portion located on an end and differing tool portions located on a second gripping arm end, the handle comprising a main body (45), three prismatic housing-guides (4*a*, 4*b*, 9) contained within the main body, the prismatic portion of each gripping arm being insertable in each of the housing-guides, each housing-guide holding and guiding an inserted gripping arm; and a self-locking lever device (3) connected to lock into place one of the gripping arms.

* * * * *